US011319669B2

(12) United States Patent
Hodson et al.

(10) Patent No.: US 11,319,669 B2
(45) Date of Patent: May 3, 2022

(54) LUBRICATING DEVICE FOR LUBRICATING A CLOTHING

(71) Applicant: VOITH PATENT GMBH, Heidenheim (DE)

(72) Inventors: Mark Hodson, Blackburn (GB); Karlheinz Straub, Heidenheim (DE); Wiebke Juergens, Heidenheim (DE); Fabian Koeberle, Heidenheim (DE)

(73) Assignee: Voith Patent GmbH, Heidenheim (DE)

( * ) Notice: Subject to any disclaimer, the term of this patent is extended or adjusted under 35 U.S.C. 154(b) by 75 days.

(21) Appl. No.: 16/335,986

(22) PCT Filed: Sep. 15, 2017

(86) PCT No.: PCT/EP2017/073258
§ 371 (c)(1),
(2) Date: Mar. 22, 2019

(87) PCT Pub. No.: WO2018/054769
PCT Pub. Date: Mar. 29, 2018

(65) Prior Publication Data

US 2020/0048834 A1 Feb. 13, 2020

(30) Foreign Application Priority Data

Sep. 22, 2016 (DE) ..... 102016218199.8

(51) Int. Cl.
*D21F 1/34* (2006.01)
*D21F 1/48* (2006.01)

(52) U.S. Cl.
CPC . *D21F 1/34* (2013.01); *D21F 1/48* (2013.01)

(58) Field of Classification Search
CPC ... D21F 1/30; D21F 1/32; D21F 1/325; D21F 1/34; D21F 1/345; D21F 1/48; D21F 1/483; D21F 1/486; D21F 1/52
(Continued)

(56) References Cited

U.S. PATENT DOCUMENTS 4,011,131 A * 3/1977 Nicholson ..... D21F 1/523 162/279
5,381,580 A * 1/1995 Kotitschke ..... B65G 45/22 15/302

(Continued)

FOREIGN PATENT DOCUMENTS

DE 202006015872 U1 1/2007
DE 102011082159 A1 3/2013

(Continued)

*Primary Examiner* — Eric Hug
(74) *Attorney, Agent, or Firm* — Laurence A. Greenberg; Werner H. Stemer; Ralph E. Locher

(57) ABSTRACT

A lubricating device lubricates a circulating clothing of a machine for manufacturing a fibrous web. The device has a body with a feed chamber that has an inlet for supplying a pressurized liquid lubricant to the feed chamber and an outlet for discharging the lubricant therefrom. The body further has a nozzle chamber to which a nozzle for discharging the lubricant is connected. The nozzle has a flow-conducting connection to the feed chamber via the nozzle chamber and the outlet. Within the body, a diffuser is provided for diffusing the lubricant supplied through the outlet along the body, the diffuser being arranged between the outlet and the nozzle.

18 Claims, 2 Drawing Sheets

(58) Field of Classification Search
USPC ..... 162/199, 275, 277–279
See application file for complete search history.

(56) References Cited

U.S. PATENT DOCUMENTS

| | | | | |
|---|---|---|---|---|
| 5,783,044 | A * | 7/1998 | Schneider | D21F 1/325 134/148 |
| 2004/0173330 | A1 | 9/2004 | McKay et al. | |
| 2006/0086827 | A1* | 4/2006 | Sekiya | B05B 7/0884 239/433 |
| 2013/0269734 | A1* | 10/2013 | Hunter | D21F 1/32 134/32 |

FOREIGN PATENT DOCUMENTS

| | | | |
|---|---|---|---|
| DE | 102013218464 | A1 | 9/2014 |
| WO | 9213132 | A1 | 8/1992 |

* cited by examiner

LUBRICATING DEVICE FOR LUBRICATING A CLOTHING

The invention relates to a lubricating device for lubricating a clothing of a machine for manufacturing a fibrous web, such as a paper, cardboard, or tissue web, as set forth in detail in the independent claim.

BACKGROUND OF THE INVENTION

Field of the Invention

When fibrous webs, and in particular paper or cardboard webs, are manufactured, the fibrous web is guided by one or more press nips in a press section of the machine and dewatered between continuous circulating belts. In such press nips the water from the fibrous web is pressed into the respective clothing, such as a felt belt.

Suction apparatuses, for example in the form of tube suckers, are used to withdraw the water that has been introduced into the felt belt. As a result, the felt belt is again receptive to water when it is run back through the press nip. Such suction apparatuses have one or a plurality of support strips that form a support surface for the felt belt that passes by the suction apparatus for dewatering. For this purpose, the mutually facing end faces of the support strips, which are arranged parallel to one another and at a distance from one another in the direction of travel of the clothing, form corresponding suction openings. A corresponding suction source is connected to the suction openings, in order to suck the support surface through the suction openings. The felt belt thus passes, for example, with its lower side toward the support surface of the suction apparatus, and is thus dewatered.

As a result of the suction, the felt belt in this area is more or less pulled against the support surface. Friction occurs between the felt belt and the support surface. This friction causes heating of the felt belt and leads to premature wear of the same felt belt due to abrasion. In addition, the support strips also are heated and worn.

To reduce the friction and cool the surfaces of the clothing, water is sprayed onto the clothing. To this end, spraying tubes are furnished, arranged at a distance from the clothing are provided, having point-shaped nozzles. However, these nozzles are prone to clogging, so a uniform moistening is not always provided over the entire working width of the suction apparatus. Furthermore, due to the relatively large distance between the spray pipes and the clothing, the air carried along by the clothing and the resulting turbulence may significantly affect the spray pattern. In practice, therefore, stripes in the felt belt are frequently observed, as a result of wear or local overheating due to inadequate lubrication. In these areas, however, the dewatering behavior of the felt belts is significantly disrupted, which has a negative effect on the moisture profile of the fibrous web and thus on the properties of the fibrous web and the operating characteristics. Therefore, the clothing must often be changed prematurely, leading to unscheduled machine downtime and thus to production losses.

For machines that do not have such a lubricating device, such a device may be retrofitted. The problem is that in this case, the suction apparatus usually must be dismantled, equipped with such a lubricating device, and then be reinstalled in the machine. Previously, retrofits of such lubricating devices have therefore had a comparatively high cost and have led to relatively lengthy machine downtime.

The present invention relates to the aforementioned general subject matter.

SUMMARY OF THE INVENTION

It is therefore an objective of the invention to provide a lubricating device that avoids the drawbacks of the prior art. In particular, the objective is to ensure efficient lubrication and cooling of the clothing while also avoiding long periods of machine downtime.

The objective is achieved by means of a lubricating device according to the independent claim. Particularly preferred and advantageous embodiments of the invention are set forth in the dependent claims.

According to the invention, a lubricating device is provided that may be retrofitted to conventional suction apparatuses—without fully disassembling them—and by means of this device, the friction between such an apparatus and a passing clothing may be significantly reduced.

The term "clothing" refers to a continuous belt in the manner of a loop. This may be, among other things, a felt or a screen that serves for the transport or further processing of the fibrous web to be manufactured or treated in the machine. Referring to such a clothing as circulating means that it rotates around itself in the circumferential direction. This direction of movement is also called the direction of travel. In this regard, the direction of travel corresponds to the machine direction and thus to the forward direction of the fibrous web in the machine.

When lubricant is mentioned in the context of the invention, a lubricant is meant that is an incompressible, pressurizable fluid, such as water or a water mixture. The lubricant lubricates the clothing against a relatively stationary support surface, such as a support strip of a suction apparatus, and serves to cool that support surface. The lubricant is discharged continuously from the lubricating device during normal operation of the machine, i.e. while the clothing is moving relative to the suction apparatus. The lubricant is introduced, via the nozzle, into the lubrication gap formed by the clothing and the support strip.

It could also be said that the lubricating device acts as a flat, hydrostatic slide bearing (linear bearing). The lubricant exiting from the nozzle is used to build up a comparatively thin lubricating film which is as uniform as possible over the width of the clothing or the body of the lubricating device. It thus separates the support strip and the clothing from each other in normal operation. To operate the slide bearing, a lubricant circuit and an associated conveyor for conveying the lubricant in the circuit may be associated with the lubricating device.

The term "lubrication plane" refers to a plane on which the lubricant is applied during normal operation. This plane substantially corresponds to the plane of the clothing as it is fed past the suction apparatus. This level is a tangential plane relative to the clothing in the area of the support strip. This plane may be defined by the lower side of the clothing—for example, the radially innermost surface of the clothing—or by the upper side of the clothing, i.e. the radially outermost surface of the clothing.

If it is said that an element bounds something at least partially, then this refers to both partial and complete bounding.

The term "main application direction of the lubricant" refers to the component of motion that is greatest in magnitude as soon as the main application direction has been divided into a horizontal and a vertical vector component. In this case, the body or the nozzle of the lubricating device should be set up or oriented relative to the clothing in such a way that the quantitatively largest component of motion of the lubricant is parallel to the clothing and in the direction of travel of the clothing. Put differently, this feature means that the lubricant is applied in the same direction as the clothing travels. It could also be said that the lubricant is applied at an angle—preferably an acute angle—in the direction of travel of the clothing, and not against that direction.

The lubricating device or body or nozzle may be set up or arranged such that, viewed in the direction of travel of the clothing, in front of the support strip, the lubricant is or may be introduced into a lubrication gap that is formed by the clothing—more precisely by the lower side of the clothing that faces the upper side of the aforementioned support strip—and the support surface or first support strip. The lubrication gap usually runs over the entire width in the transverse direction to the direction of travel of the clothing. In the lubrication gap, the lubrication plane is preferably parallel to the surface of the clothing.

The lubricating device or the body may be set up or arranged in such a way that the mouth of the nozzle reaches or reaches into the boundary of the lubrication gap, or touches the lubrication plane, i.e. is at least partially in that plane.

The nozzle may be designed in such a way that its cross-section is continuously reduced, i.e. without an abrupt narrowing of the cross-section, for lubricant flowing in the (main) discharge direction. In principle, however, a discontinuous narrowing of the cross sectional constriction is also conceivable.

"Mouth" refers to the end of the nozzle as seen in the (main) lubricant discharge direction. It is the part of the nozzle where the lubricant emerges as a free jet.

The nozzle or its mouth could also be jointly bounded by the body and the (first) support strip, for example by their respective, mutually facing end faces. Also, both of these could be designed in such a way that there is a nozzle that has a cross-section for lubricant that, for example, continuously tapers in the main propagation direction.

The lubricating device may therefore be arranged directly below the clothing and may be set up in such a way as to apply lubricant to the lubrication gap in the direction of travel of the clothing. Put differently, the lubricating device is arranged in the space bounded by the clothing and the suction apparatus.

In principle, it would be conceivable that the body could also be designed as one piece with a support strip, in particular preferably with the first support strip of the suction apparatus, as viewed in the direction of travel of the clothing. In the case of retrofitting a machine with the lubricating device, e.g. the first support strip would be removed and replaced by the unit consisting of the body and first support strip.

When it is said that two elements bound or enclose an angle together, the smaller of the angles is always meant. According to the invention, such an angle is measured in a plane that is parallel to the direction of travel of the clothing and also perpendicular to the clothing.

An "acute angle" refers to an angle between 0° and 90°, and preferably between 0° and 75°, and preferably between 0° and 45°, inclusive. In the case where the angle is 0°, the main application direction and the direction of travel coincide, or are parallel to each other and extend in the same direction.

The term "normal operation" refers to the state of the machine in which the desired fibrous web is made from the pulp suspension and further processed on the machine. In detail, in this state, the clothing moves continuously along its direction of travel relative to the suction apparatus or lubricating device. Excess water is removed for dewatering through the suction openings of the suction apparatus. In contrast, in a non-operating state of the machine, e.g. when the machine is taken out of commission for maintenance, manufacturing the fibrous web in this way is not possible. During normal operation, the lubricating device in the machine is built onto or attached to the suction apparatus.

For the purposes of the invention, "fibrous web" refers to a scrim or tangle of fibers, such as wood fibers, plastic fibers, glass fibers, carbon fibers, additives, admixtures or the like. Thus, the fibrous web may be formed, for example, as a paper, cardboard or tissue web substantially comprising wood fibers, in which small amounts of other fibers or additives and admixtures may also be present.

A support strip according to the invention is usually longer than the width of the clothing or fibrous web being manufactured, the width being measured perpendicular to the direction of travel of the clothing or fibrous web.

In addition, the invention also relates to a combination of a lubricating device and a clothing.

The invention also relates to an additional combination, of a lubricating device with a support strip of a suction apparatus.

The invention also relates to a system comprising a lubricating device and a suction apparatus. The system may then be associated with least one circulating clothing.

Finally, the present invention relates to a machine for manufacturing a paper, cardboard, or tissue or other fibrous web, comprising at least one clothing and a lubricating device, or a system consisting of a lubricating device and a suction apparatus.

According to another embodiment, for lubricating a belt of a machine for manufacturing a fibrous web, such as paper, cardboard, or tissue web, the lubricating device may comprise a body that forms or at least partially bounds a nozzle for dispensing a printing medium, the nozzle being arranged such that its longitudinal central axis—with the lubricating device installed—forms an angle, preferably an acute angle, and preferably the cross-section of the nozzle, as viewed in the direction of application of the pressure medium, narrows-preferably continuously—with the mouth of the nozzle being in the lubrication plane and preferably at least one diffuser is incorporated within the body or nozzle, or is formed by either of these.

BRIEF DESCRIPTION OF THE SEVERAL VIEWS OF THE DRAWING

The invention will be explained in greater detail below with reference to the drawings, without limiting its generality. The drawings show the following.

DESCRIPTION OF THE INVENTION

Figure 1:
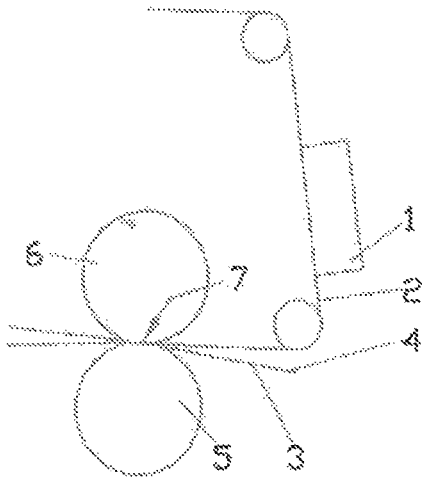
FIG. 1 a highly schematic side view of a press section of a machine.

FIG. 1 shows a schematic side view, not to scale, of a press section of a machine for manufacturing a fibrous web, such as a paper, cardboard, or tissue web.

The press section comprises a press nip 7 formed by two press rolls 5 and 6. To symmetrically dewater a fibrous web 4, the web is guided through the press nip 7 to be sandwiched jointly between a first clothing 2 and a second clothing 3. Here, the function of the clothing 2, 3, which may be designed as felt belts, consists of receiving the water that exits the fibrous web 4 in the press nip 7. Thus, each belt is in direct contact with the fibrous web 4 on its respective upper side, and with the corresponding press roll 5, 6 on its lower side.

The clothings 2, 3 are designed as continuous belts and circulate around the press nip 7 on corresponding rollers. Past the press nip 7, as viewed in the direction of travel of the belts 2, 3 (from left to right through the press nip 7), the belts must be dewatered. For this purpose, at least one suction apparatus 1 is used, and in this case is designed to be stationary. "Stationary" means that it is stationary from the standpoint of the clothing that moves relative to it.

The suction apparatus 1 will now be described in greater detail with reference to FIGS. 2 and 3, in the context of a clothing. Both drawings show such an apparatus in a cross-section through a plane parallel to the direction of travel of the clothing 2, this plane also thus being perpendicular to the width direction of the clothing 2. In principle, another suction apparatus 1 could be associated with the second clothing 3.

Figure 2:
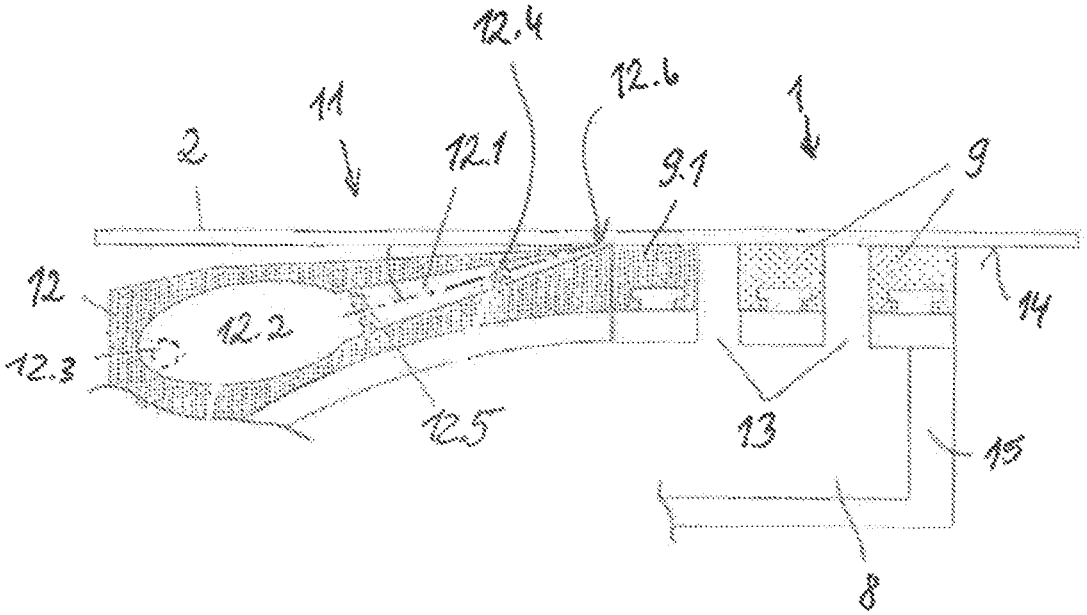
FIG. 2 a highly schematic sectional view of a system made up of a suction apparatus and a lubricating device, according to a first embodiment.
Figure 3:
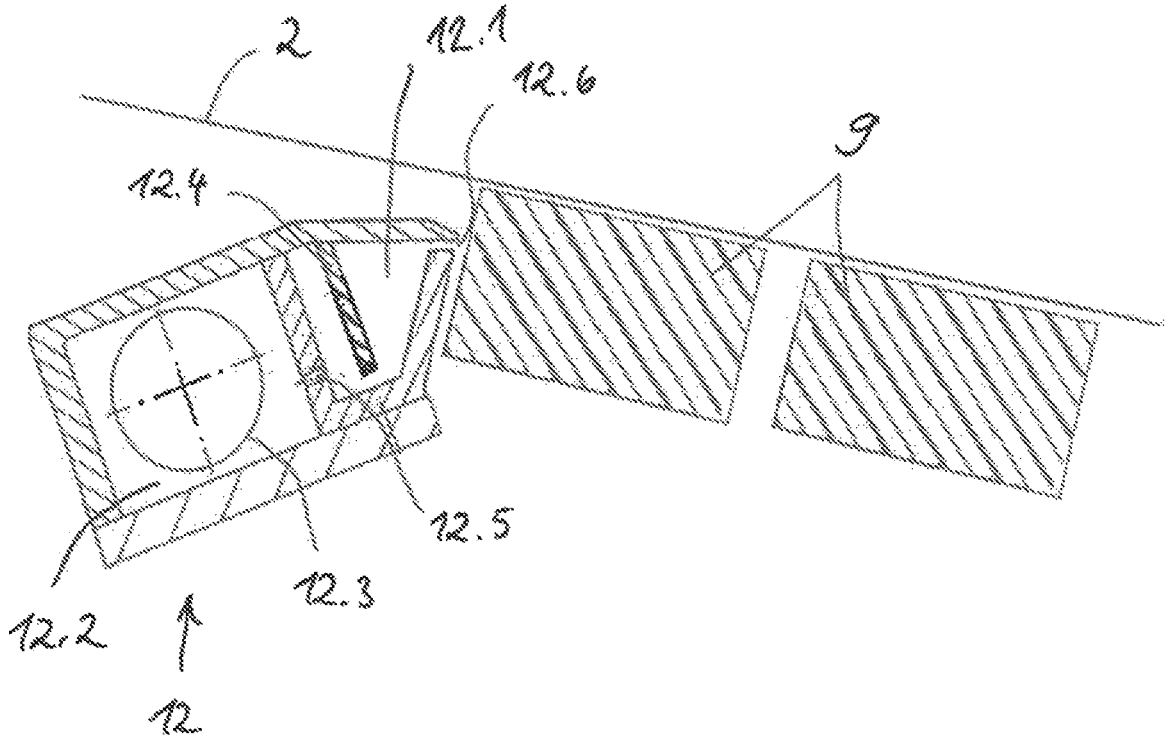
FIG. 3 a highly schematic sectional view of a system made up of a suction apparatus and a lubricating device, according to a second embodiment.

In FIGS. 2 and 3, the clothing 2 rotates from left to right.

The suction apparatus 1 of FIG. 2 comprises at least one inner chamber 8 that may be coupled to a suction source, not shown. Further, a plurality of support strips 9 is provided, which are arranged, with respect to their longitudinal axes, perpendicular to the direction of travel of the clothing 2, 3, and are arranged in parallel and at a distance from each other. The support strips 9 are arranged in a plane that is parallel to the plane defined by the clothing 2, 3. The inner chamber 8 is bounded by a housing 15 of the suction apparatus 1, which is shown only in a detail view here. The support strips 9 are mounted on the upper side of the housing 15, which faces the clothing 2.

The support strips 9 together with their upper sides, which face the lower side of the first clothing 2, jointly form a support surface 14 for supporting the clothing 2. When the suction apparatus 1 is installed, the support surface 14 is directed toward the clothing 2, more precisely toward the lower side thereof. The surface runs parallel to the clothing 2. The support surface 14 here corresponds to the lubrication plane. A plurality of suction openings 13 are provided in the support surface. These openings are bounded, for example, by the support strips 9, which are directly adjacent to the end faces that face one another. The suction openings 13 are connected to the inner chamber 8 in a fluidic, and therefore lubricant-conducting, manner. These openings usually run over the entire width of the clothing 2, or beyond its width. In the present case, the width direction extends perpendicularly in the image plane of FIG. 2, i.e. perpendicular to the direction of travel of the clothing 2 and parallel to the longitudinal axis of the support strips 9. Lubricant, for example water, that has flowed into the inner chamber 8 via the suction openings 13, may be sucked out of the inner chamber via the suction source.

The suction apparatus 1 is associated with a lubricating device 11 in the present case. The lubricating apparatus is arranged in front of a first support strip 9.1, as viewed in the direction of travel of the clothing 2. The "first support strip 9.1" refers to that support strip of the suction apparatus 1 that is first swept by the clothing 2, as viewed in the clothing's direction of travel. Although not shown, a single support plate could also form the support plane, instead of the plurality of support strips arranged spaced apart from one another. The support plate would then have corresponding suction openings 13.

The lubricating device 11 is associated with a body 12, which in this case forms a nozzle 12.6 in its interior for dispensing pressure medium. A reservoir or feed chamber 12.2 is arranged for the pressure medium in front of the nozzle 12.6, in the flow direction of the pressure medium. This chamber is also formed by the body 12. The cross section of the feed chamber 12.2 for the pressure medium is larger than that of the nozzle 12.6, as viewed at least at the mouth thereof. This is because the nozzle 12.6 has a tapering cross section—starting from the feed chamber 12.2—as viewed in the flow direction of the pressure medium.

The body 12 or nozzle 12.6 is arranged in such a way that, during normal operation, it continuously discharges the pressurized lubricant emerging from it onto the lower side of the clothing 2. More specifically, the lubricant is introduced into a lubrication gap bounded by the lower side of the clothing 2 and the support surface 14. The nozzle 12.6 is arranged at an acute angle to the clothing 2 with respect to the longitudinal central axis of the nozzle. As a result, the main application direction of the lubricant exiting the mouth of the nozzle 12.6 substantially corresponds to the direction of travel of the clothing 2. The main application direction thus corresponds to an extension of the longitudinal central axis of the nozzle 12.6 beyond its mouth, on the lubrication plane. By means of such an arrangement of the nozzle 12.6, it is possible for lubricant to flow particularly well into the lubrication gap. The lubricant flows into the lubrication gap even better when the mouth of the nozzle 12.6 is arranged in the vicinity of the lubrication gap, or in or near the lubrication plane. "Near" means that the vertical distance from the mouth to the lubrication plane is a few millimeters.

A targeted introduction of the lubricant into the lubrication gap, and thus improved cooling and lubrication of the clothing 2, may also be achieved because the mouth of the nozzle 12.6 is at the same time bounded or formed by the body 12 and the first support strip 9.1. In such a case, the mouth is also directly in the lubrication gap.

Alternatively, it would be conceivable for the nozzle 12.6 to be bounded or formed by the body 12 alone. The longitudinal central axis of the nozzle could then be at the aforementioned angle to the lubrication plane.

On the lower side of the lubricating device 11, which faces the inner chamber 8 of the suction apparatus 1, this axis has a bent shape. It adapts to the contour of the suction apparatus, which here is designed as a tube sucker.

As further shown in FIG. 2, the body 12 may be associated with a diffuser 12.4. Such a diffuser 12.4 operates as a shutter for the lubricant. For example, it may have a plurality of openings. The diffuser 12.4 serves to equalize the volumetric flow of the lubricant exiting from the outlet 12.5 inside the body 12. The outlet 12.5 is usually realized via a plurality of openings. The lubricant exits these openings in the form of individual jets with high flow velocity. If these individual jets were to reach the nozzle 12.6 directly without the interposition of such a diffuser, an uneven velocity distribution would result at the mouth of the nozzle 12.6 along the longitudinal extent of the body 12. This in turn would mean that the lubricating film runs unevenly over the length of the lubrication gap.

As a result of providing the diffuser 12.4, the individual jets of lubricant, viewed in the lubricant flow direction, first encounter the diffuser 12.4 before the lubricant reaches the nozzle 12.6. The diffuser 12.4 reduces the comparatively high inflow velocity of the individual jets into the nozzle chamber 12.1, with the goal of creating the most uniform flow possible. Thus, by means of the diffuser 12.4, a uniform and uniform-velocity outflow of the lubricant is thus achieved over the entire length of the body 12, and thus a uniform lubricant film thickness is achieved in the lubrication gap.

The diffuser 12.4 may thus be designed in the manner of a baffle plate, for example a flat, quadrilateral belt which extends over the entire width of the nozzle 12.1, and thus at least over the width of the clothing 2.

As illustrated here, the diffuser 12.4 may be arranged in the region of the transition from the feed chamber 12.2 into the nozzle chamber 12.6, and especially inside the nozzle chamber 12.6. It could likewise conceivably be arranged inside the feed chamber 12.2. In any case, the diffuser 12.4 should in any case be arranged at a location within the body 12 where there are individual jets of lubricant having a comparatively high flow velocity, and thus behind the outlet 12.5 as seen in the flow direction.

In principle, two or more diffusers 12.4 arranged behind one another could also be provided in the lubricant flow direction.

FIG. 3 shows a further embodiment of the suction apparatus 1 or lubricating device 11. This is constructed analogously to the embodiment of FIG. 2; the wall 15 and inner chamber 8 are not shown here. Therefore, what has already been said with reference to FIG. 2 applies analogously.

Here likewise, the lubricating device 11 comprises a body 12, with which a feed chamber 12.2 and a nozzle chamber 12.1 for lubricant are associated. The feed chamber 12.2 likewise has a lubricant-conducting connection to a lubricant source, not shown, via the inlet 12.3. Pressurized lubricant is fed to the feed chamber 12.2 and thus to the nozzle chamber 12.1 via the inlet 12.3.

Here likewise, the feed chamber 12.2 and nozzle chamber 12.1 have a flow-conducting connection with one another. This is accomplished via an outlet 12.5.

This outlet is implemented as a plurality of openings, such as through holes, in the wall that separates the feed chamber 12.2 and nozzle chamber 12.1. The openings are distributed over the entire length of the body 12, and thus here in the direction toward the plane of the drawing. Put differently, the outlet 12.5 opens inside the nozzle chamber 12.1. The lubricant exiting from the outlet 12.5 thus passes from the feed chamber 12.2 into the nozzle chamber 12.1, from there into the nozzle 12.6 and from there into the lubrication gap.

Viewed in the lubricant flow direction, a diffuser 12.4 is arranged downstream of the outlet 12.5. This diffuser covers the outlet 12.5 in such a way that the individual jets emerging from the outlet 12.5, or from the openings, collide at the diffuser 12.4.

The diffuser 12.4 extends into the nozzle chamber 12.1 in such a way that both the longitudinal axis of the outlet 12.5 and the longitudinal axis of the diffuser 12.4 intersect in the illustrated section. This ensures that the individual jets of lubricant exiting the outlet 12.5 always collide at the diffuser 12.4.

Because the diffuser 12.4 extends into the flow of the lubricant from the outlet 12.5 to the nozzle 12.6 in this way, the diffuser 12.4, together with the wall of the nozzle chamber 12.1 in which it is arranged, forms a cross-sectional constriction—in the manner of a shutter—for the lubricant. The diffuser 12.4 thus extends only over part of the flow cross-section for the nozzle chamber 12.1 for lubricant. The diffuser 12.4 separates the nozzle chamber 12.1 into two sub-chambers that are connected to one another in a flow-conducting manner.

The lubricant is consequently scattered and homogenized as it passes from the outlet 12.5 to the nozzle 12.6; thus, the diffuser 12.4 reduces the comparatively high inflow velocity of the individual jets into the nozzle chamber 12.1. This makes it possible to achieve as uniform a flow as possible in the region of the mouth of the nozzle 12.6, which ultimately leads to a uniform outflow of the lubricant and thus to a uniform lubricant film thickness in the lubrication gap.

The diffuser 12.4 is designed here as a flat baffle plate. In the present case, it has a surface area that is greater than the surface area of the flow cross-section of the outlet 12.5. This also applies analogously to the embodiment of FIG. 2. As a result, the flow velocity of the lubricant in the region of the mouth of the nozzle 12.6 is particularly well homogenized. It may thus be arranged within the body 12, preferably within the nozzle chamber 12.1.

The diffuser 12.4 may be furnished separately from the body 12, preferably separately from the nozzle chamber 12.1. However, it could also be designed as one piece together with the body 12.

In addition, the diffuser 12.4 could extend over the entire flow cross-section of the nozzle chamber 12.1. In that case, the diffuser could be provided with corresponding openings—similarly to the feed chamber 12.2 with its outlet 12.5. Alternatively, the diffuser could be designed, for example, as a network in order to even out the lubricant flowing out of the outlet 12.5.

As shown in FIG. 3, the lubricant flow cross-section narrows continuously in the lubricant flow direction and opens into the slit-shaped nozzle 12.6. Irrespective of the described embodiment, clogging of the nozzle 12.6 during operation is avoided by this arrangement according to the invention and by the shape of the nozzle. This is facilitated by the fact that the lubricant runs substantially along the direction of travel of the clothing 2, for example at an acute angle. Objects entering the lubrication gap are thus flushed out of the lubrication gap due to both the movement of the clothing 2 and the application of the lubricant. This also applies analogously to the embodiment of FIG. 2.

As shown in the drawings, the body 12 or the nozzle 12.6 may extend over or beyond the entire width of the lubricating device 11, the suction apparatus 1 or the clothing 2. The nozzle 12.6 may be designed so as to create a slit nozzle having e.g. a quadrilateral cross-section as its mouth—as viewed from above the lubrication plane. The mouth may extend over the entire width of the clothing 2 (perpendicular to its direction of travel). Alternatively, a plurality of bodies 12 may be furnished that are arranged transversely to the direction of travel of the clothing and form the correspondingly described nozzles 12.6.

Likewise independently of the embodiment shown, as a general matter, the body 12 on the upper side facing the clothing 2, 3 could have a wearing component (not shown). Such a part may be made of a comparatively softer material than the body 12 itself—for example, a plastic. It serves to avoid damage to the lower side of the clothing 2, 3 in the event of a touch. The wearing component may be replaceable; for example, it may be mounted on the body 12 by means of screws.

If the surface area of the flow cross-section of the outlet 12.5 is dimensioned so that—viewed in the longitudinal direction of the body 12—between 100 and 200 $mm^2$ is selected per linear meter of the body 12, then there is particularly good lubrication in the lubrication gap. The same applies if the selected flow rate of lubricant is between 5 and 20 liters per minute per linear meter of the body 12.

As a result of the design of the lubricating device according to the invention, this takes up comparatively little space due to its compactness. It may also be retrofitted to existing suction apparatuses without requiring them to be disassembled. At the same time, efficient lubrication and cooling of the clothing may be achieved.

The invention claimed is:

1. A combination of a suction apparatus having a body with at least one suction opening formed therein, and a lubricating device for lubricating a circulating clothing of a machine for manufacturing a fibrous web, the lubricating device comprising:

a body including:

a feed chamber having an inlet for supplying a pressurized liquid lubricant to said feed chamber and an outlet for discharging the pressurized liquid lubricant from said feed chamber;

a nozzle;

a nozzle chamber to which said nozzle is connected for discharging the pressurized liquid lubricant, said nozzle having a flow-conducting connection to said feed chamber via said nozzle chamber and said outlet; and a diffuser for diffusing the pressurized liquid lubricant supplied via said outlet along said body of the lubricating device, said diffuser disposed between said outlet and said nozzle;

wherein all of said nozzle is formed in said body of the lubricating device, and wherein all of said body of the lubricating device is separate from the body of the suction apparatus.

2. The lubricating device according to claim 1, wherein:

said diffuser is disposed within said nozzle chamber; and/or said nozzle extends in a longitudinal direction of said body of the lubricating device.

3. The lubricating device according to claim 1, wherein said nozzle chamber forms or bounds said nozzle.

4. The lubricating device according to claim 1, wherein:

said nozzle chamber has a wall; and said diffuser is separate from said wall of said nozzle chamber and is fastened to said wall.

5. The lubricating device according to claim 4, wherein said diffuser is a flat baffle plate.

6. The lubricating device according to claim 1, wherein said outlet of said feed chamber is bounded by or configured as a plurality of openings in a wall of said feed chamber.

7. The lubricating device according to claim 1, wherein said outlet of said of the feed chamber has an opening cross-section dimensioned for the pressurized liquid lubricant in such a way that, viewed in a longitudinal direction, a resulting surface area is 100 to 200 $mm^2$ per meter of length of said body of the lubricating device.

8. The lubricating device according to claim 1, wherein the lubricating device is configured such that a flow rate of the pressurized liquid lubricant through the lubricating device is 5 to 20 liters per minute per meter of the lubricating device.

9. The lubricating device according to claim 2, wherein said nozzle is configured as a slit nozzle.

10. A configuration, comprising:

a suction apparatus having a body with at least one suction opening formed therein;

a lubricating device of a machine for manufacturing a fibrous web, said lubricating device including a body, said body of the lubricating device having:

a feed chamber with an inlet for supplying a pressurized liquid lubricant to said feed chamber and an outlet for discharging the pressurized liquid lubricant from said feed chamber;

a nozzle;

a nozzle chamber to which said nozzle is connected for discharging the pressurized liquid lubricant, said nozzle having a flow-conducting connection to said feed chamber via said nozzle chamber and said outlet; and a diffuser for diffusing the pressurized liquid lubricant supplied via said outlet along said body of the lubricating device, said diffuser disposed between said outlet and said nozzle;

a clothing; and said lubricating device lubricating a surface of said clothing, and said clothing sweeping along a direction of travel over said lubricating device;

wherein all of said nozzle is formed in said body of the lubricating device, and wherein all of said body of the lubricating device is separate from the body of the suction apparatus.

11. The configuration according to claim 10, wherein said lubricating device is set up in such a way that the pressurized liquid lubricant impinges on said clothing in the direction of travel of said clothing.

12. The configuration according to claim 10, wherein said clothing is a felt or a screen of the machine for manufacturing the fibrous web, the fibrous material is selected from the group consisting of paper, cardboard, and a tissue web.

13. The configuration according to claim 10, wherein said lubricating device is set up in such a way that the pressurized liquid lubricant impinges on said clothing in the direction of travel of said clothing at an acute angle.

14. A system of a machine for manufacturing a fibrous web selected from the group consisting of paper, cardboard, and tissue web, the system comprising:

a lubricating device including a body, said body of the lubricating device having:

a feed chamber with an inlet for supplying a pressurized liquid lubricant to said feed chamber and an outlet for discharging the pressurized liquid lubricant from said feed chamber;

a nozzle;

a nozzle chamber to which said nozzle is connected for discharging the pressurized liquid lubricant, said nozzle having a flow-conducting connection to said feed chamber via said nozzle chamber and said outlet; and a diffuser for diffusing the pressurized liquid lubricant supplied via said outlet along said body of the lubricating device, said diffuser disposed between said outlet and said nozzle; and a suction apparatus having at least one support strip on which a circulating clothing may be guided, one surface of said support strip is movable relative thereto along a direction of travel, wherein said lubricating device is disposed immediately before said at least one support strip in the direction of travel of the clothing and wherein said suction apparatus has a body with at least one suction opening formed therein;

wherein all of said nozzle is formed in said body of the lubricating device, and wherein all of said body of the lubricating device is separate from the body of the suction apparatus.

15. The system according to claim 14, wherein said body, of the lubricating device, has a side facing said suction apparatus, and said side has a shape that is complementary to said suction apparatus.

16. A machine for manufacturing a fibrous web selected from the group consisting of paper, cardboard, and a tissue web, the machine comprising:

a suction apparatus having a body with at least one suction opening formed therein;

at least one clothing; and a lubricating device including a body, said body of the lubricating device having:

a feed chamber with an inlet for supplying a pressurized liquid lubricant to said feed chamber and an outlet for discharging the pressurized liquid lubricant from said feed chamber;

a nozzle;

a nozzle chamber to which said nozzle is connected for discharging the pressurized liquid lubricant, said nozzle having a flow-conducting connection to said feed chamber via said nozzle chamber and said outlet; and a diffuser for diffusing the pressurized liquid lubricant supplied via said outlet along said body of the lubricating device, said diffuser disposed between said outlet and said nozzle;

wherein all of said nozzle is formed in said body of the lubricating device, and wherein all of said body of the lubricating device is separate from the body of the suction apparatus.

17. A machine for manufacturing a fibrous web selected from the group consisting of paper, cardboard, and a tissue web, the machine comprising:

at least one clothing; and a system, including:

a suction apparatus having a body with at least one suction opening formed therein;

a lubricating device including a body, said body of the lubricating device having:

a feed chamber with an inlet for supplying a pressurized liquid lubricant to said feed chamber and an outlet for discharging the pressurized liquid lubricant from said feed chamber;

a nozzle;

a nozzle chamber to which said nozzle is connected for discharging the pressurized liquid lubricant, said nozzle having a flow-conducting connection to said feed chamber via said nozzle chamber and said outlet; and a diffuser for diffusing the pressurized liquid lubricant supplied via said outlet along said body of the lubricating device, said diffuser disposed between said outlet and said nozzle;

a suction apparatus having at least one support strip on which a circulating clothing may be guided, one surface of said support strip is movable relative thereto along a direction of travel, wherein said lubricating device is disposed immediately before said at least one support strip in the direction of travel of the clothing;

wherein all of said nozzle is formed in said body of the lubricating device, and wherein all of said body of the lubricating device is separate from the body of the suction apparatus.

18. The lubricating device according to claim 1, wherein said body of the lubricating device has a first support strip which when installed in the machine replaces a first support strip of said suction apparatus.

* * * * *